US010124304B2

(12) United States Patent
Drocco et al.

(10) Patent No.: US 10,124,304 B2
(45) Date of Patent: Nov. 13, 2018

(54) ASSEMBLY OF A TINTOMETRIC MACHINE AND A TROLLEY

(71) Applicants: Luca Drocco, Alba (IT); Mario Drocco, Alba (IT)

(72) Inventors: Luca Drocco, Alba (IT); Mario Drocco, Alba (IT)

( * ) Notice: Subject to any disclaimer, the term of this patent is extended or adjusted under 35 U.S.C. 154(b) by 15 days.

(21) Appl. No.: 15/522,714

(22) PCT Filed: Oct. 27, 2015

(86) PCT No.: PCT/IB2015/058259

§ 371 (c)(1),
(2) Date: Apr. 27, 2017

(87) PCT Pub. No.: WO2016/067186

PCT Pub. Date: May 6, 2016

(65) Prior Publication Data

US 2017/0326515 A1 Nov. 16, 2017

(30) Foreign Application Priority Data

Oct. 28, 2014 (IT) ..... TO2014A0877

(51) Int. Cl.
*B67D 7/78* (2010.01)
*B01F 13/00* (2006.01)
(Continued)

(52) U.S. Cl.
CPC ..... *B01F 13/0018* (2013.01); *B01F 13/1058* (2013.01); *B01F 15/00155* (2013.01); *B01F 15/00928* (2013.01); *B01F 2215/005* (2013.01)

(58) Field of Classification Search
CPC ..... B01F 13/1058; B01F 2215/005
(Continued)

(56) References Cited

U.S. PATENT DOCUMENTS 5,493,840 A * 2/1996 Cane ..... B01F 13/1055 53/50
6,793,387 B1 * 9/2004 Neas ..... B01F 13/1058 141/104

(Continued)

FOREIGN PATENT DOCUMENTS

| | | |
|---|---|---|
| EP | 0176140 A2 | 4/1986 |
| ES | 2169957 A1 | 7/2002 |
| WO | 2011/061406 A1 | 5/2011 |

OTHER PUBLICATIONS

International Search Report and Written Opinion of International Patent Application No. PCT/IB2015/058259, dated Feb. 9, 2016.

*Primary Examiner* — Jeremy W Carroll
(74) *Attorney, Agent, or Firm* — Merchant & Gould P.C.

(57) ABSTRACT

Assembly of a tintometric machine and a trolley includes an external frame and a dispenser system. The dispenser system dispenses a fluid into a vessel or container, when the vessel or container is positioned in a dispensing station. The trolley includes: a supporting top, whereon the container can be positioned; rotary elements allowing the trolley to move; a gripping element, through which the user can grip the trolley and move it. The dispensing station has a housing into which the trolley can be positioned. The assembly includes a plug-socket system, wherein a first part of the system is located on the trolley and a second part is located in the dispensing station. The parts of the system can be assembled together when the trolley is placed into the housing of the dispensing station, for the purpose of conducting an electric current. The trolley includes an actuating device that can move the supporting top.

8 Claims, 6 Drawing Sheets

(51) Int. Cl.
*B01F 13/10* (2006.01)
*B01F 15/00* (2006.01)

(58) Field of Classification Search
USPC ..... 222/145.5
See application file for complete search history.

(56) References Cited

U.S. PATENT DOCUMENTS

| | | | | |
|---|---|---|---|---|
| 8,534,778 | B2 | 9/2013 | Chen et al. | |
| 8,905,087 | B2 * | 12/2014 | Airaksinen | B01F 13/1055 141/103 |
| 2005/0087545 | A1 * | 4/2005 | Petrus Engels | B01F 13/1058 222/1 |
| 2006/0118581 | A1 * | 6/2006 | Clark | B01F 13/1055 222/333 |
| 2013/0199663 | A1 * | 8/2013 | Newbold | B67D 7/30 141/9 |
| 2014/0326748 | A1 * | 11/2014 | Post | B67D 7/3245 222/55 |

* cited by examiner

ASSEMBLY OF A TINTOMETRIC MACHINE AND A TROLLEY

This application is a National Stage Application of International Patent Application No. PCT/IB2015/058259, filed 27 Oct. 2015, which claims benefit of Serial No. TO2014A000877, filed 28 Oct. 2014 in Italy and which applications are incorporated herein by reference. To the extent appropriate, a claim of priority is made to each of the above disclosed applications.

BACKGROUND OF THE INVENTION

The present invention relates to an assembly made up of a tintometric machine and a lift trolley, said assembly allows moving the containers into which the desired quantity of fluid will be dispensed by the tintometric machine, allowing the tintometric machine to operate only when the trolley is correctly positioned inside the tintometric machine.

Tintometric machines are known which comprise an external structure for containing a plurality of containers or canisters to which one or more dispenser systems are connected, the latter being able to dispense a desired quantity of a fluid, such as paints, particularly dyes, into a vessel or container arranged in a dispensing station or emplacement.

Said machines must be extremely compact and versatile in terms of their possible applications (e.g. they must contain a large number of canisters to provide a wide range of colours), as well as easy to maintain.

Said machines must be compact and easy to use, and must require as little maintenance as possible.

On the other hand, in the event of a failure they must be easily repairable at low costs and with short downtimes.

Tintometric machines are known which comprise a dispensing station where a container, e.g. a tin, is positioned for being filled, at least partially, with fluids contained in canisters comprised in the tintometric machine.

Tintometric machines are known which comprise a housing for big containers. Said containers can normally be transported by means of independent trolleys or handling means. Said housings cannot also accommodate said trolleys or handling means.

No solution known in the art envisages a system for handling containers or vessels which also allows them to be transported outside the tintometric machine and which ensures that the container is properly positioned in the tintometric machine, regardless of the dimensions of the container itself.

SUMMARY OF THE INVENTION

The present invention aims at solving the above-mentioned technical problems by providing a tintometric machine that forms an assembly together with a trolley that can be positioned in the machine itself, being coupled mechanically and electronically thereto. In addition, said trolley, being connected to the control circuit of the tintometric machine, allows handling the container in such a way that the container can be correctly positioned under the delivery point.

One aspect of the present invention relates to an assembly of a tintometric machine and a trolley.

BRIEF DESCRIPTION OF THE DRAWINGS

The features of the assembly of a tintometric machine and a trolley will become clear and apparent in the light of the following description of some possible embodiments thereof and of the annexed drawings, which illustrate one exemplary embodiment of the present invention. More in detail, the drawings respectively illustrate the following:

FIG. 1A shows an axonometric front view and FIG. 1B shows a top view of the machine;

FIG. 2A shows an axonometric front view and FIG. 2B shows a top view of the machine;

FIG. 3A shows a front view of the assembly in the closed configuration, FIG. 3B shows a side view of the assembly in a closed configuration of the machine, FIG. 3C shows a front view in an open operating configuration of the machine;

FIG. 5A shows a side view and FIG. 5B shows a perspective view;

DETAILED DESCRIPTION OF THE PREFERREDE EMBODIMENT(S)

Figure 1B:
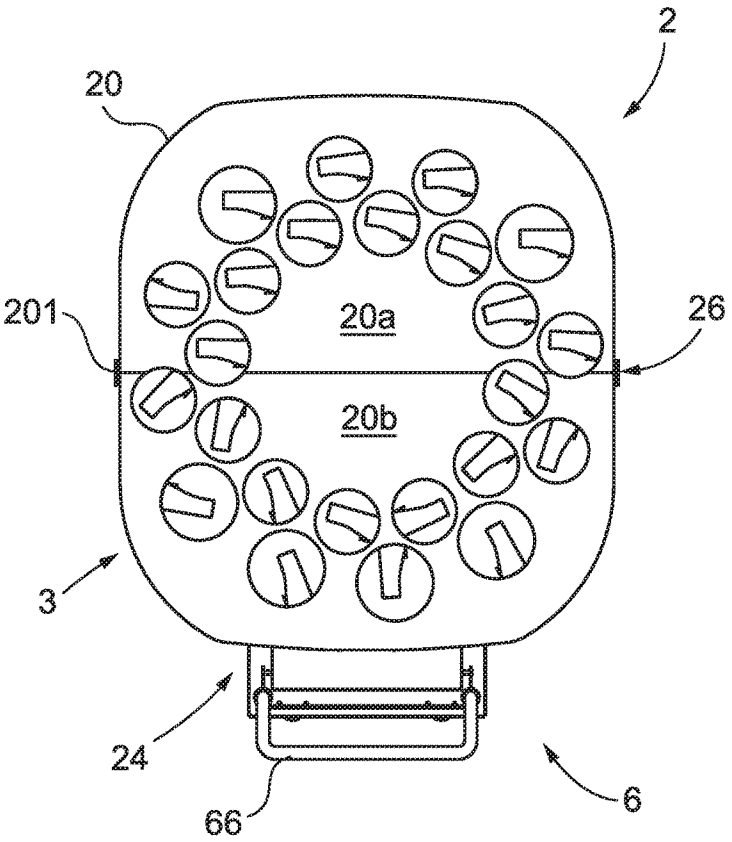
FIGS. 1A, 1B show one possible embodiment of the tintometric machine, in particular associated with a trolley, in a closed configuration; respectively.

With reference to the above-listed drawings, tintometric machine 2 constitutes an assembly together with a trolley 6.

Machine 2 comprises an external frame 20 made from rigid material, such as, for example, metal or plastic materials, which defines an internal area 21.

Said internal area 21 houses at least one dispenser system 3. Said dispenser system 3, included in tintometric machine 2, can dispense a fluid, e.g. a paint, in particular a dye, into a vessel or container "C". Said vessel or container "C" is normally intended for use by the final user.

Said dispenser system 3 comprises a plurality of canisters or containers 34 and one or more dispenser mechanisms 32, each one comprising at least one pump 321 and at least one valve assembly 323, of a type known to those skilled in the art.

Said canisters or containers 34 are connected to one or more dispenser mechanisms 32 either in a direct manner, e.g. one dispenser mechanism 32 per canister 34, or in a sequential manner, thus sharing one or more dispenser mechanisms 34, as is known to those skilled in the art.

Trolley 6 comprises a supporting top 62, whereon at least one container "C" can be placed; rotary elements 64, e.g. wheels, allowing trolley 6 to move on a plane; and a gripping element 66, e.g. a handrail portion or a handle, through which the user can grip trolley 6 for exerting a force, whether directly or via an actuator, such as a motor, in order to move the trolley.

Figure 5B:
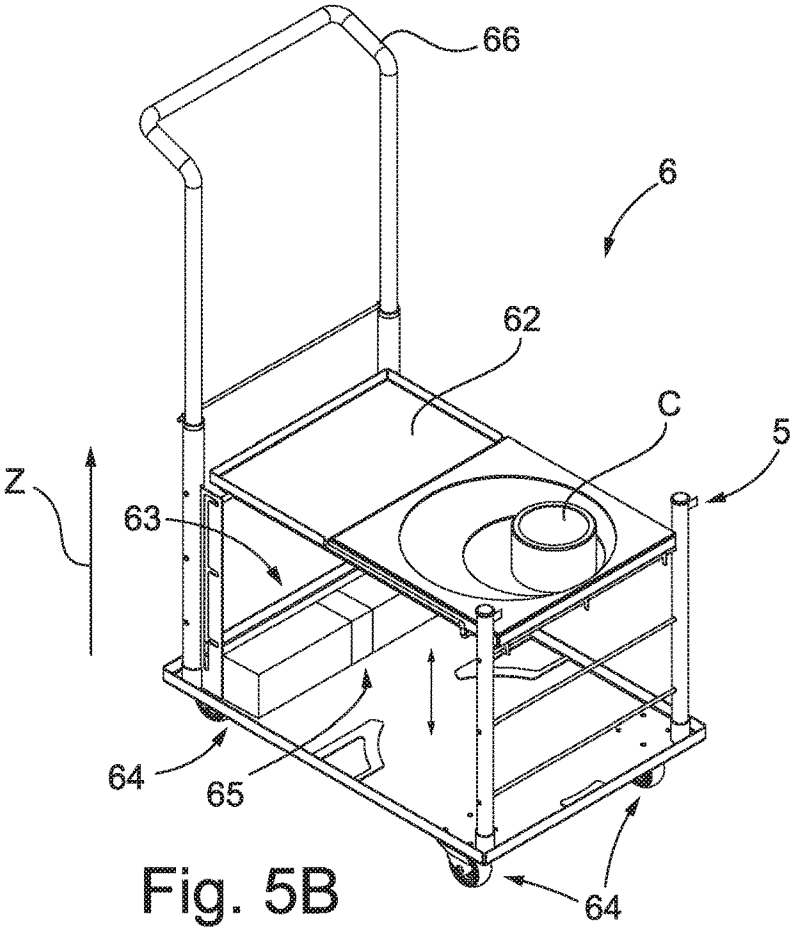
FIGS. 5A and 5B show two different views of the trolley.
Figure 5A:
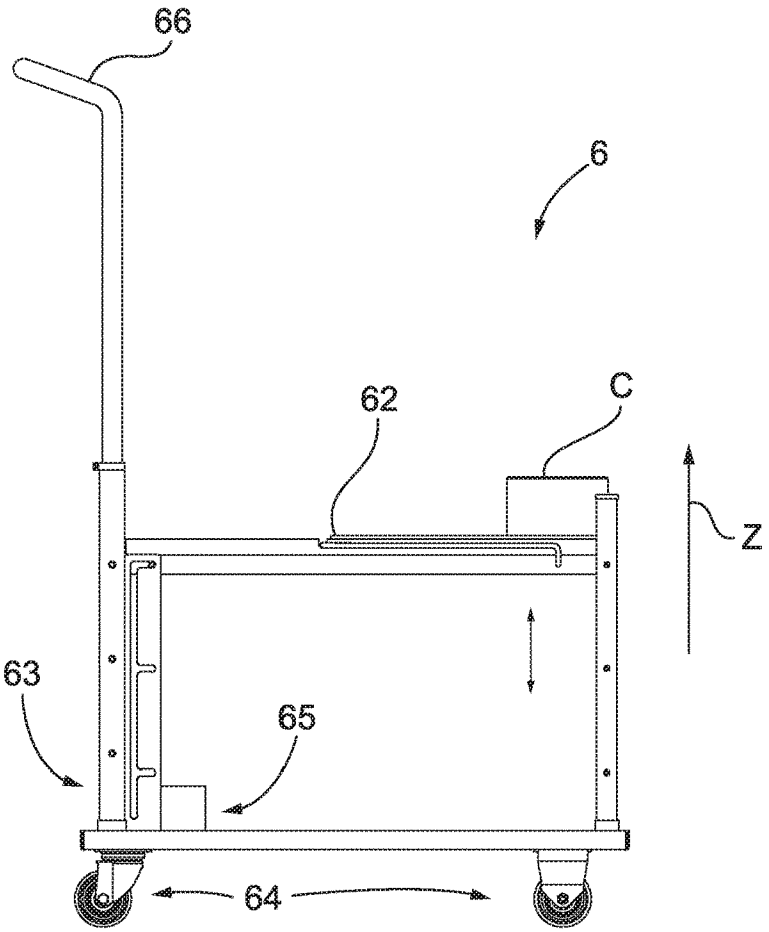

For example, said trolley 6 may comprise a propulsion system, e.g. an electric motor, capable of moving said rotary elements 64, such as, for example, wheels or tracks, for moving trolley 6. FIGS. 5A and 5B illustrate one exemplary and non-limiting possible embodiment of trolley 6.

Preferably, said supporting top 62 comprises a plurality of housings, e.g. coaxially arranged, allowing any vessel or container "C", of shape or dimensions, to be placed on supporting top 62, ensuring that the vessel will be properly retained while moving trolley 6. In the embodiment shown in FIG. 5B, said plurality of housings are arranged tangentially relative to one another.

Figure 7:
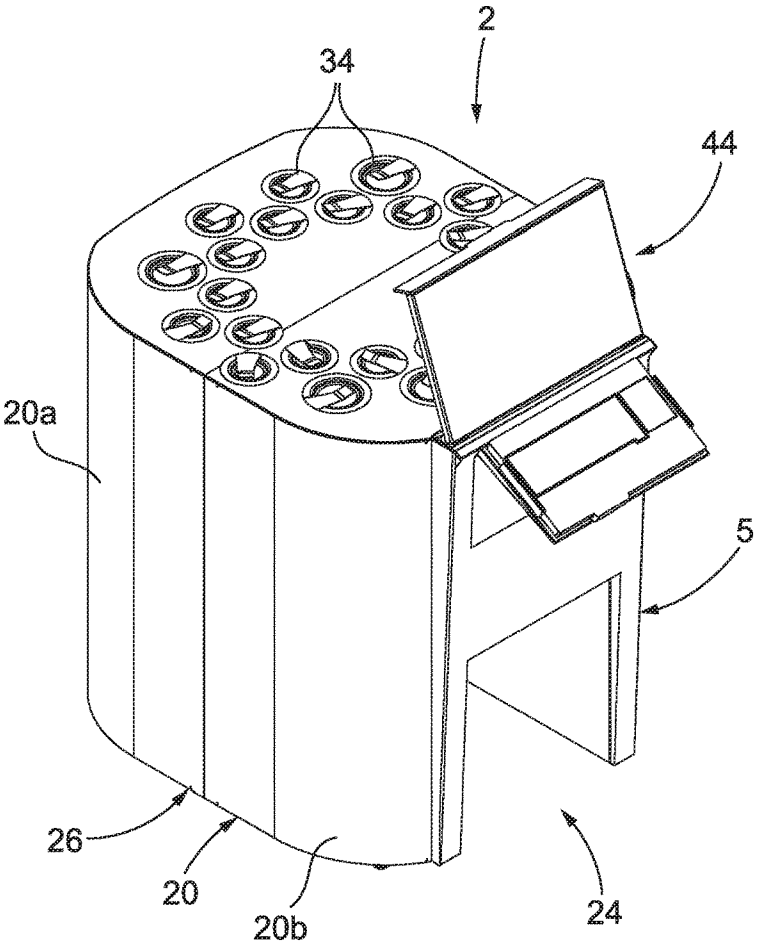
FIG. 7 shows an embodiment of the tintometric machine, comprising at least one user interface.

Said dispensing station 24 comprises a housing "H" into which said trolley 6 can be positioned, as shown by way of example in FIG. 7.

The assembly made up of tintometric machine 2 and trolley 6 comprises a first plug-socket system 5, wherein a first part of system 5 is located on trolley 6 and a second part of the same system 5 is located in dispensing station 24. The parts of the first plug-socket system 5 can be assembled together when said trolley 6 is put into housing "H" of dispensing station 24.

In the assembled condition, said first plug-socket system 5 can conduct an electric current.

Said first part may be either said plug or said socket of plug-socket system 5. Said second part may be either said plug or said socket of plug-socket system 5. Said plug-socket system can be implemented in several ways known to those skilled in the art, which will not therefore be detailed below. Also, said part of said plug-socket system may include sliding contacts.

In general, trolley 6 according to the present invention is not permanently secured to tintometric machine 2, but can be moved and released from said tintometric machine 2, e.g. for moving container "C" away from tintometric machine 2 and putting it in another place, or vice versa, thus facilitating the user in transporting vessel or container "C", which can be carried on trolley 6 instead of being carried by hand. Trolley 6 turns out to be especially useful when container "C" is big.

The trolley comprises an actuating device 63 that can move said supporting top 62 for the purpose of changing at least the dimension along a vertical axis "Z" of the same supporting top 62.

In one possible embodiment, said trolley 6 comprises a power supply device 65, e.g. an electric accumulation battery, which can at least supply power to said actuating device 63.

In the embodiment wherein said rotary elements 64 are drive wheels, the motion system of trolley 6 itself may be powered, at least partly, by power supply device 65.

FIGS. 5A and 5B show by way of example the place where actuating device 63 and power supply device 65 are located relative to the structure of trolley 6.

In one embodiment, said actuator 63 can move said supporting top 62 at least along said vertical axis "Z", e.g. causing said supporting top 62 to slide along guides, e.g. formed in the very structure of trolley 6.

Said movable supporting top 62 allows the assembly to introduce containers "C" of any shape and dimensions into tintometric machine 2.

In one possible alternative, said supporting top 62 is driven by said actuating device 62, making a rotary movement. In the present embodiment, said supporting top 62 is secured to an arm hinged on one end to the supporting top 62 itself and on the other end to trolley 6, which can rotate about the pivot point on said trolley 6. This embodiment includes a stabilization device that can keep said supporting top always parallel to the ground, by causing it to rotate about the point where it is pivoted to said arm. In a further possible embodiment, movement occurs by means of a pantograph system.

In one possible embodiment, said supporting top 62 can be moved between different heights, e.g. corresponding to the different dimensions of containers "C" that can be used in tintometric machine 2 according to the present invention.

In an alternative embodiment, actuating device 63 can move said supporting top 62 to a number of heights greater than three, thus allowing an accurate adjustment of the level at which said supporting top 62 must be positioned, e.g. with a 1 mm resolution.

The assembly according to the present invention comprises a locking device 7 capable of locking trolley 6 in housing "H" of dispensing station 24 of tintometric machine 2. In one possible embodiment, said locking device 7 is a movable abutting element which, when activated upon proper positioning of trolley 6 in housing "H", will abut against the trolley to prevent any movement thereof, e.g. by positioning a locking element. In alternative embodiments, said locking device 7 may be mechanical, electromechanical or electric. Said locking device 7 may act upon the structure of trolley 6, e.g. of gripping element 66, or upon rotary elements 64.

Said locking device 7 may be associated with external frame 20 of tintometric machine 2 or may be arranged on the trolley itself. In such an embodiment, said locking device can, for example, position itself into a suitable cavity in tintometric machine 2 when the trolley is correctly positioned in housing "H" of tintometric machine 2.

Figure 1A:
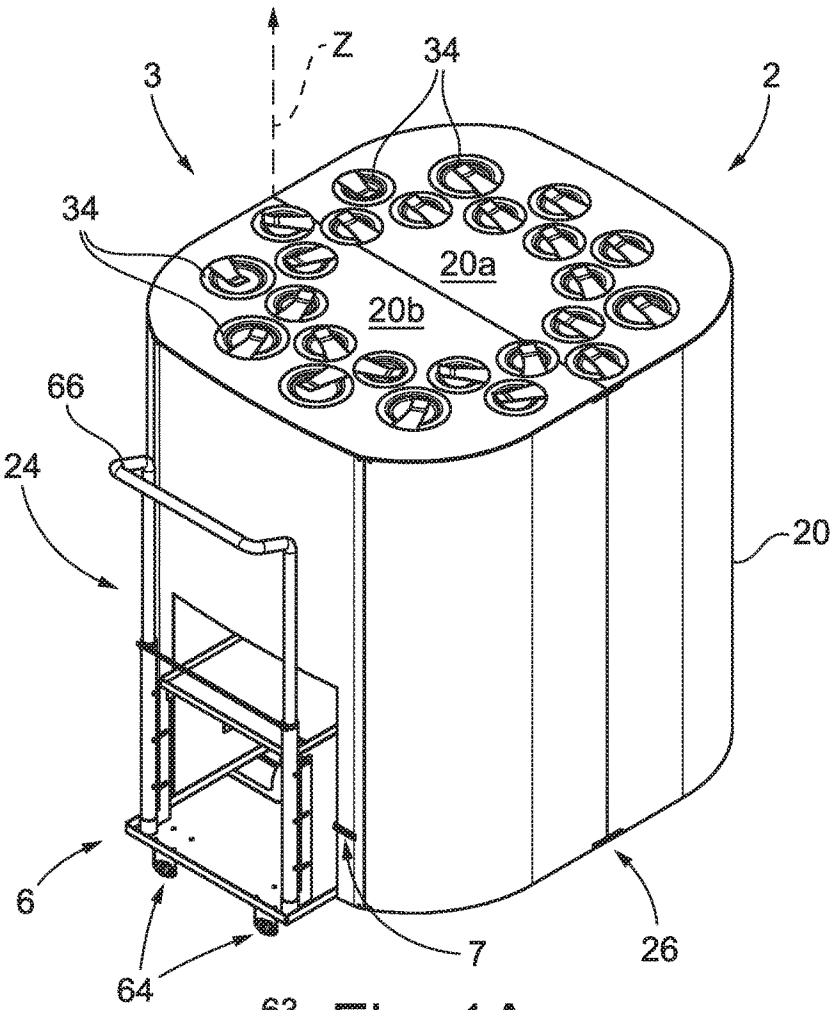
Figure 3B:
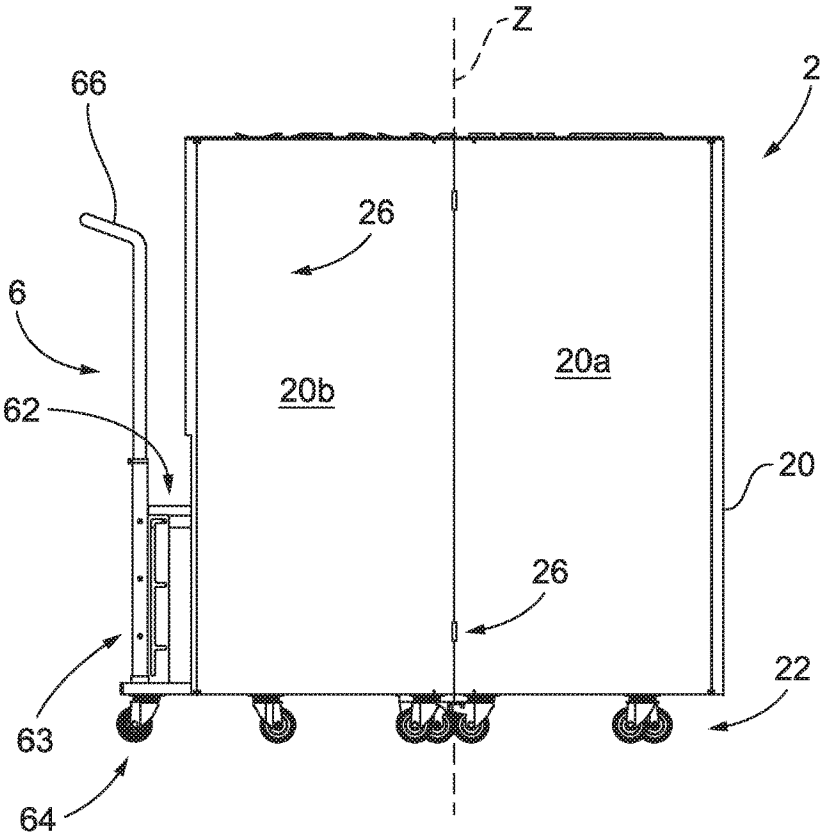
FIGS. 3A, 3B and 3C show one possible embodiment of the tintometric machine, in particular associated with a trolley, in the two different operating configurations; respectively.
Figure 3A:
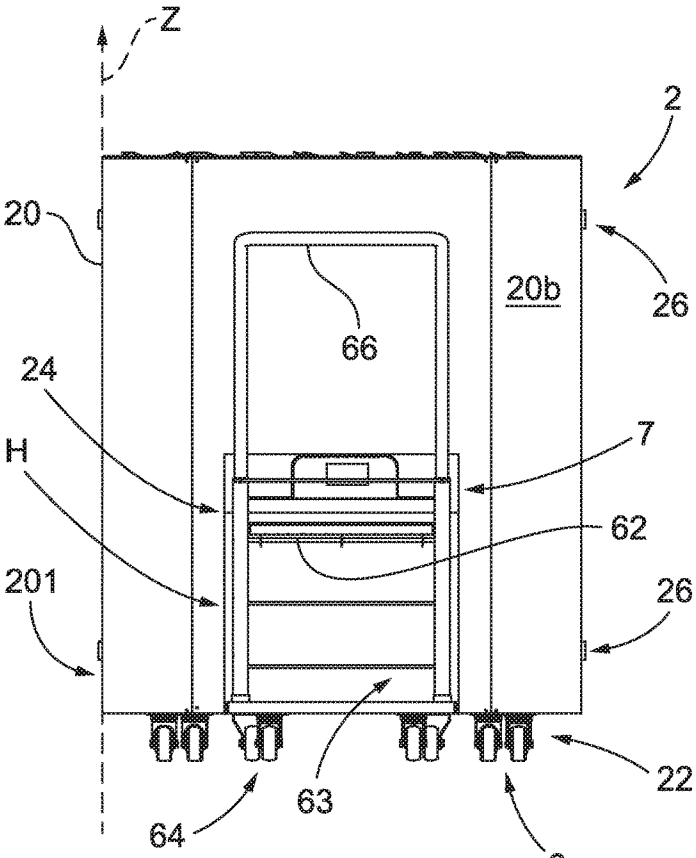

In the exemplary embodiments shown in FIGS. 1A and 3A, the locking device is positioned, by way of example, at the inlet of housing "H", on external frame 20 of the machine.

Preferably, tintometric machine 2 comprises an electronic control system 4, which can control said trolley 6, e.g. by controlling said actuating device 63 of trolley 6, when trolley 6 is in housing "H", in particular when it is correctly positioned therein. In a preferred embodiment, said control system 4 comprises a data processing unit 41.

Preferably, electronic control system 4 controls actuating device 63 of the trolley when the first plug-socket system 5 is in the assembled configuration.

Control system 4, and in particular said data processing unit 41, can activate said actuating device 63 for moving said supporting top 62 in order to position it correctly at dispenser system 3 for the execution of a dispensing operation, as a function of the size of vessel or container "C" placed on said supporting top 62. Likewise, once tintometric machine 2 has completed the dispensing operation, electronic control system 4, in particular data processing unit 41, will activate actuating device 63 in order to cause supporting top 62 to make the opposite movement, so that trolley 6 can then be moved.

The correct movement of supporting top 62, and in particular of container or vessel "C" positioned thereon, is controlled by at least one sensor, which can determine the position of container "C" with respect to dispenser mechanisms 32. Said sensor may be a position or distance sensor, arranged either on trolley 6 or inside dispensing station 24. Said sensor is electrically connected to said electronic control system 4.

In addition, said control system 4 is electrically connected to both said second plug/socket system 5 and said locking device 7. This electric connection allows monitoring the presence of trolley 6 in housing "H" of dispensing station 24 and activating locking system 7 accordingly in order to lock or release trolley 6.

Figure 6:
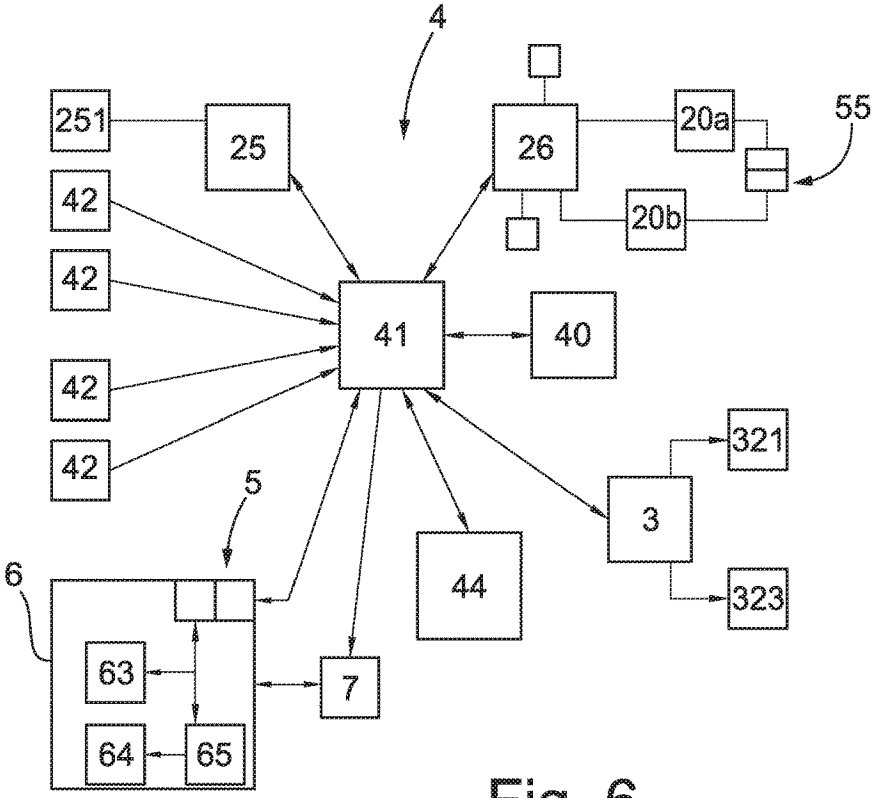
FIG. 6 shows a block diagram of the general control system for controlling the tintometric machine according to the present invention.

One possible embodiment of electronic control system 4 is shown by way of example in FIG. 6.

Said control system 4, in the case of automated rotary elements 64, can also control the motion of the latter, e.g. for moving trolley 6 if it is not correctly positioned inside housing "H", for the purpose of positioning it correctly or for removing trolley 6 in a controlled manner from housing "H", and vice versa. Control system 4 may also control rotary elements 64 in order to brake them, whether directly, i.e. by electronically imposing that they remain still, e.g. during a dispensing operation of tintometric machine 2, or indirectly, i.e. by activating one or more actuators comprised in or cooperating with said locking device 7 for braking the movements of rotary elements 64 in order to stop trolley 6. These embodiments may comprise a first plug-socket system 5 with sliding contacts, or may be integrated with a wireless connection, at least for some handling functionalities of trolley 6.

FIGS. 1A, 1B, 3A and 3B illustrate a tintometric machine 2 in which trolley 6 has been properly positioned, e.g. for the execution of a dispensing operation.

In one possible embodiment, said trolley 6 comprises an adjustable gripping element 66, the longitudinal extension of which, in particular its height from the ground, can be varied. This feature allows adjusting the height of gripping element 66 as a function of the user's characteristics.

In one possible embodiment, said trolley 6 can move said supporting top 62, so as to facilitate the positioning of container "C" on the same supporting top 62, e.g. by moving it out of the outline of trolley 6 itself, e.g. along at least one axis perpendicular to vertical axis "Z".

Being openable, said external frame 20 has a shell-shaped structure. External frame 20 opens in such a way that tintometric machine 2 will be divided into at least two portions (20*a*, 20*b*), which may even have different dimensions.

In general, each portion (20*a*, 20*b*) contains a part of dispenser system 3, which is housed therein. By dividing said at least two portions, an inspection area "M" is defined between portions (20*a*, 20*b*), which is accessible to an operator. Said inspection area allows the operator to stand between portions (20*a*, 20*b*) of external frame 20, so that he can easily and directly see all the parts of dispenser system 3.

The present solution provides substantially direct access to all the parts of tintometric machine 2, while also clearing an area where the operator can comfortably carry out maintenance work without having to remove other components of the machine in order to gain access to the desired part and/or to work on the device requiring service or maintenance.

The portions are separated from each other, so that some parts of dispenser system 3 will remain associated with a first portion 20*a* and other parts will remain associated with a second portion, and so on for the whole number of portions into which said frame 20 can be opened and divided.

The exemplary embodiment shown in the annexed drawings adopts a solution wherein the machine can be divided into two portions.

Figure 2B:
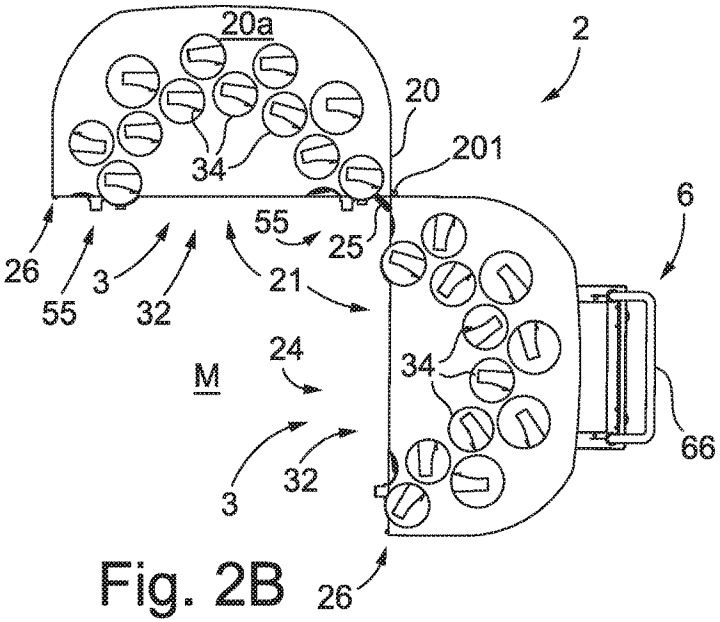
FIGS. 2A, 2B show one possible embodiment of the tintometric machine in an open configuration; respectively.
Figure 2A:
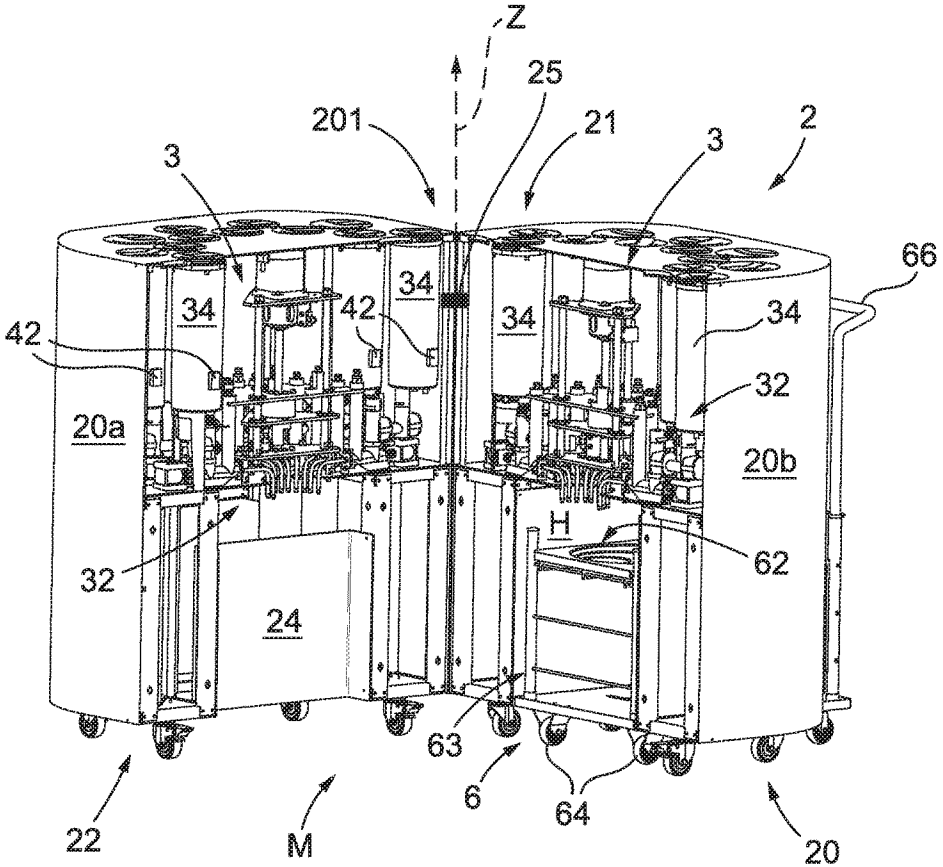
Figure 3C:
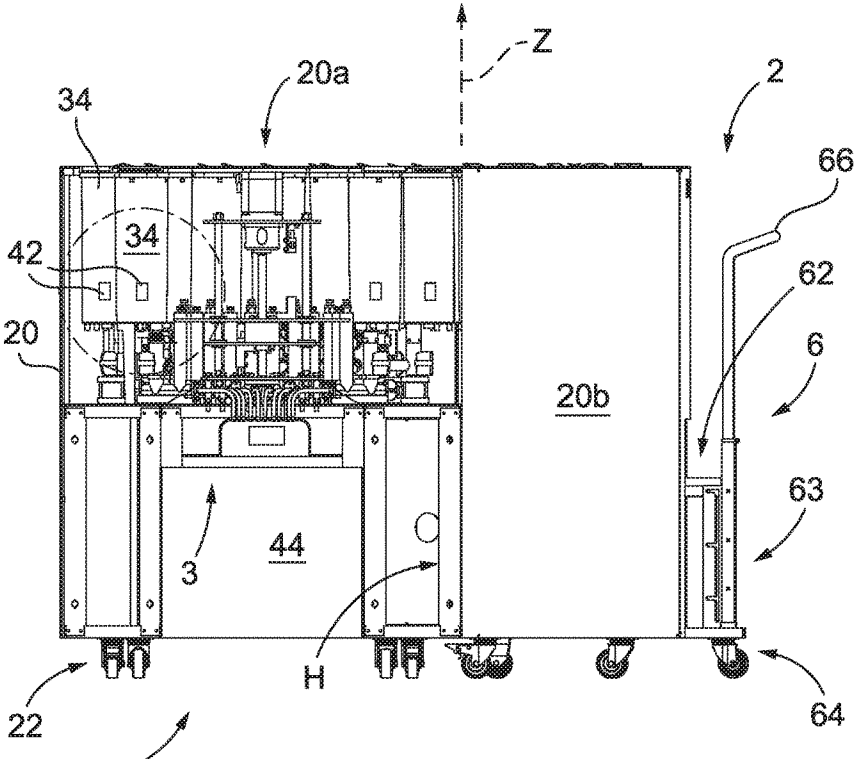

FIGS. 2A, 2B and 3C show an embodiment wherein trolley 6 can remain associated with tintometric machine 2 even when the tintometric machine is in an open operating configuration, e.g. during maintenance.

In an alternative embodiment (not shown), the machine can be divided into three portions, e.g. a machine 2 wherein a first portion represents one half of the machine, while a second portion and a third portion constitute each one quarter of the machine. Dispenser system 3 may be equally distributed among the various parts, e.g. depending on the machine portion represented by them.

Preferably, said portions (20*a*, 20*b*) are hinged to each other in order to be able to rotate about a vertical axis "Z", thus moving relative to each other.

In alternative embodiments, the two parts can be separated and slide along one or more longitudinal guides, e.g. arranged along an axis perpendicular to said vertical axis "Z". Though not shown herein, hybrid forms envisaging a longitudinal motion followed by a rotary motion should also be considered as falling within the protection scope of the present invention.

The illustrated embodiment comprises at least one hinge 201, preferably at least three hinges, arranged along a vertical axis "Z" on one side of tintometric machine 2, so that portions (20*a*, 20*b*) can rotate about said axis "Z". The relative motion between portions (20*a*, 20*b*) allows the creation of an inspection area "M" where the operator can stand, e.g. in order to carry out maintenance activities on tintometric machine 2.

In the illustrated embodiment, inspection area "M" has a wedge-like shape, including a circumference sector of 60° to 120°, preferably 90°.

In one possible embodiment of tintometric machine 2, an opening device 25 is included, which can open, or at least contribute to opening, machine 2, in particular external frame 20. Said opening mechanism allows machine 2 to be opened in an at least partially automatic manner, thus moving said portions (20*a* 20*b*) for generating said inspection area "M".

In a simpler but equally functional embodiment, the opening of machine 2, in particular of portions (20*a*, 20*b*), is effected in a substantially manual manner. For example, portions (20*a*, 20*b*) are manually secured or released by means of a lock, and portions (20*a*, 20*b*) are also moved manually for generating said area "M".

The tintometric machine according to the present invention comprises a closing mechanism 26 that can hold together portions (20*a* 20*b*) of machine 2 when the same machine 2 is in a closed operating configuration, a second plug-socket system 55 being included for supplying power to at least a part of machine 2, e.g. to at least said dispenser system 3. In the assembled condition, said second plug-socket system 55 can conduct an electric current.

In particular, said closing mechanism 26 is an electric or electromechanical one, so as to avoid that said machine 2, and in particular external frame 20, might open accidentally. Said closing system 26 allows keeping tintometric machine 2 closed by means of electromechanical or electric fastening elements known to those skilled in the art.

Said closing mechanism 26 further comprises sensors capable of detecting when tintometric machine 2 has been properly closed.

As aforementioned, tintometric machine 2 comprises an electronic control system 4. Said control system 4 is also adapted to control at least one of opening mechanism 25 and closing mechanism 26.

Said electronic control system 4 is preferably also adapted to control said sensors for detecting that machine 2 has been properly closed.

In one possible embodiment, said opening mechanism 25 comprises at least one actuator 251 for exerting a force in order to move apart, at least partially, portions (20*a* 20*b*) of frame 20 of machine 2, for the purpose of contributing, at least partly, to generating said inspection area "M".

Said at least one actuator 251 may be an electric or pneumatic device, such as an air spring or a thrust jack.

In the embodiment shown in the drawings, the portions are two, so that the machine will be divided into two halves.

FIGS. 1A and 1B show the machine in a closed configuration, whereas FIGS. 2A and 2B show the machine in an open configuration. As can be seen in the above-mentioned figures, portions (20*a*, 20*b*) internally comprise part of dispenser system 3, comprising part of canisters 34 and part of dispenser mechanisms 32. The present solution allows dividing the entire tintometric machine 2 substantially in half.

Said closing system 26, as aforementioned, comprises at least one sensor for detecting when external frame 20 of tintometric machine 2 has been properly closed.

Said second plug-socket system 55 allows deactivating in a quick and safe manner at least said dispenser system 3 when tintometric machine 2 is in an open operating configuration. The same system allows, when the machine is brought back into the closed operating configuration, supplying power simply and quickly to said dispenser system 3. In the proposed solution, when machine 2 is opened all actuators will be de-energized, particularly those included in dispenser system 3, such as, for example, dispenser mechanisms 32.

In a preferred embodiment, said data processing unit 41 allows activating machine 2, e.g. for executing a step of dispensing one or more fluids, after having verified, e.g. upon interrogation, that closing system 26 detects that the machine has been properly closed.

Said solution allows access to dispenser system 3 for maintenance purposes; in particular, dispenser mechanisms 32 are easily accessible, thus making maintenance easier.

Said tintometric machine 2 comprises a motion mechanism 22, e.g. wheels, for moving the same machine on a plane.

Said motion mechanism makes it easier to open tintometric machine 2, in that it promotes relative motion between portions (20*a*, 20*b*).

In a tintometric machine 2 according to the present invention, electronic control system 4 comprises, in addition to a data processing unit 41, also a plurality of level sensors 42, the latter being electrically connected to said data processing unit 41.

Figure 4:
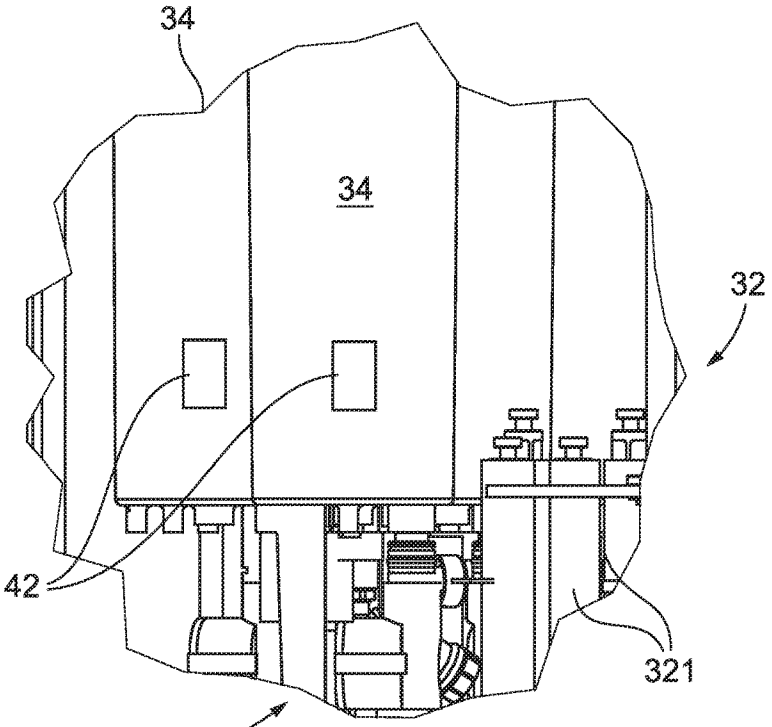
FIG. 4 shows the detail "A" encircled in FIG. 3C, wherein a dispenser mechanism and canisters fitted with level sensors are more visible.

At least one level sensor 42 is associated with each canister or container 34 included in tintometric machine 2, in particular in dispenser system 3. FIG. 4 shows an embodiment wherein a plurality of canisters 34 are visible, with each one of which at least one sensor 42 is associated.

Said level sensor 42 is an electronic sensor. In the preferred embodiment, sensor 42 of the capacitive type.

In the present embodiment, said data processing unit 41 can acquire the data from level sensors 42 automatically. The data acquired by data processing unit 41 are used for monitoring the fluid levels in canisters or containers 34.

The solution according to the present invention allows monitoring the quantity of fluid contained in a canister 34, e.g. by determining the level thereof inside canister 34, even during the steps of filling and/or refilling canister 34 with the respective fluid. The present solution can also determining if the quantity of fluid in canister 34 has reached a minimum level. One or both of the above-mentioned effects are obtainable through the use of electronic sensors, in particular capacitive level sensors.

The present solution turns out to be particularly simple and suitable for handling a large number of canisters 34, leading to lower production costs.

In an exemplary but non-limiting embodiment, said data processing unit 41 acquires the data from all the level sensors 42. In one possible embodiment, acquisition may occur in a substantially simultaneous manner, or upon interrogation after the occurrence of an event, or periodically, or sequentially.

In a preferred embodiment of tintometric machine 2, the same comprises a user interface 44 through which the user, for example, can obtain information about the operation of the machine.

Said user interface 44 is electrically connected to data processing unit 41.

Through said user interface 44 it is possible to verify the proper positioning of trolley 6 inside the housing. In this solution, the data processing unit will return a visual and/or audible indication about the proper positioning of trolley 6.

The data acquired by data processing unit 41, received from level sensors 42, e.g. upon interrogation, are processed by processing unit 41 itself. The data thus processed are then returned, via the user interface 44, in the form of at least one visual indication of the level, whether absolute or indicative, of the fluid contained in one or more canisters or containers 34. In a preferred embodiment, said user interface 44 can generate at least one visual indication about the level of all containers, whether simultaneously or for groups of one or more containers, e.g. upon request from the user/operator. As aforementioned, the visual indication thus obtained may represent the actual fluid contents of canister 34, or it may represent an estimate depending on input data, e.g. entered by an operator. At any rate, control system 4, in accordance with the present invention, will be at least able to return an actual indication when the quantity of fluid in a canister 34 reaches a predefined minimum threshold.

Said user interface 44 also allows providing a visual and/or audible indication about the operating state of the machine, e.g. indicating if the machine is in an open configuration or whether it has been properly closed or not.

In the preferred but non-limiting embodiment, user interface 44 comprises at least one display. A data input device, such as a keyboard, or a pointing device, such as a mouse, may also be included, or all these functionalities may be integrated into an active screen, or "touch screen".

The solution according to the present invention also allows, in addition to monitoring and controlling the level of product, in particular fluid, in each canister or container 34 included in tintometric machine 2, the execution of a diagnostic function in order to obtain a real-time update of the quantity of fluid in the canisters, at least if there is a preset minimum quantity. It may even be possible to obtain an estimate of the times by which maintenance activities will have to be carried out, such as filling or refilling one or more canisters 34 with product or fluid.

In the solution according to the present invention, said data processing unit 41, through a mathematical algorithm stored in a memory medium 40, preferably a non-volatile one, may be able to calculate and return, via user interface 44, a piece of information relating to an estimate of the time by which a maintenance activity will have to be carried out. In particular, said algorithm will be able to return an estimate of the times by which the fluid contents of one or more canisters 34 will become exhausted.

In an exemplary but non-limiting embodiment, said algorithm can provide an estimate of the time by which a fluid in one or more canisters 34 will become exhausted by executing the following steps:

calculating an average between the fluid quantities taken from at least one canister 34 and dispensed by dispenser system 3 during a predefined number of dispensing operations carried out by machine 2, e.g. a number of dispensing operations between 10 and 100.

calculating the number of dispensing operations still executable, considering the contents of one or more canisters 34, on the basis of the previously calculated quantity dispensed on average.

Said estimate may be referred to either a single container or, in general, to all containers.

Other types of computation algorithms may also be implemented, e.g. probabilistic ones.

Furthermore, said algorithm, and in particular the computer program which, when executed by said data processing unit 41, allows the execution of the steps of the algorithm, may be implemented in "machine learning" mode.

Preferably, at least after each dispensing operation carried out by tintometric machine 2, electronic control system 4 verifies the contents of one or more canisters 34, in particular of at least those used during the last dispensing operation.

Preferably, said electronic control system 4 is the same system that automatically controls dispenser system 3; and in particular, it can control and drive dispenser mechanisms 32 in ways which are known to those skilled in the art. The same control system 4, and in particular the same data processing unit 41, sends the data to user interface 44, for returning one or more visual or audible indications about the operation of tintometric machine 2, and may receive data, e.g. from the same user interface 44, for entering information about, for example, how to perform the dispensing operation, e.g. for the purpose of setting the dye to be obtained.

The same user interface 44 may be used for entering information about the times and/or quantities of product loaded in one or more canisters 34.

The tintometric machine constitutes an assembly together with a trolley that can be positioned therein, being mechanically and electronically coupled thereto. In addition, said trolley, being connected to the control circuit of the tintometric machine, allows handling the container in such a way that it can be correctly positioned under the delivery point.

Tintometric machine 2 and/or the assembly comprising trolley 6 offers all the previously mentioned advantages.

The present solution allows creating an assembly of a tintometric machine and a trolley. Said trolley can be positioned in the machine, being mechanically and electronically coupled thereto. In addition, said trolley, being connected to the control circuit of the tintometric machine, allows handling the container in such a way that it can be correctly positioned under the dispensing point. The present solution also allows handling containers or vessels outside the tintometric machine and ensures that the container will be properly positioned in the tintometric machine, regardless of the dimensions of the container itself.

REFERENCE NUMERALS

Tintometric machine 2
External frame 20
Portions 20*a*, 20*b*
Hinges 201
Internal area 21
Motion mechanism 22
Dispensing station 24
Opening mechanism 25
Actuator 251
Closing mechanism 26
Dispenser system 3
Dispenser mechanisms 32
Pump 321
Valve assembly 323
Canisters or containers 34
Electronic control system 4
Memory medium 40
Data processing unit 41
Level sensors 42
User interface 44
First plug-socket system 5
Second plug-socket system 55
Trolley 6
Supporting top 62
Actuating device 63
Rotary elements 64
Power supply device 65
Gripping element 66
Locking device 7
Vessel or container C
Housing H
Inspection area M
Vertical axis Z

The invention claimed is:

1. Assembly of a tintometric machine and a trolley, said machine comprising an external frame, defining an internal area that houses a dispenser system;

said dispenser system dispensing a fluid into a vessel or container, when said vessel or container is positioned in a dispensing station in said machine;

said dispenser system comprises a plurality of canisters or containers and one or more dispenser mechanisms, each one of the dispenser mechanisms comprising at least one pump and at least one valve assembly;

said canisters or containers are connected to one or more dispenser mechanisms;

said trolley comprises:

a supporting top, whereon at least one container can be positioned;

rotary elements allowing said trolley to be moved on a plane;

a gripping element, through which the user can grip the trolley for exerting a force in order to move the trolley;

said dispensing station comprises a housing into which said trolley can be positioned;

the assembly comprises a plug/socket system, wherein a first part of the system is located on the trolley and a second part of the system is located in the dispensing station, parts of the system can be assembled together when said trolley is placed into the housing of the dispensing station; said plug/socket system being electrically conductive in the assembled configuration;

an actuating device that can move said supporting top for changing at least a dimension along a vertical axis of the supporting top.

2. The assembly according to claim 1, wherein said trolley comprises a power supply device capable of supplying power to said actuating device.

3. The assembly according to claim 1, wherein said actuator can move said supporting top at least along said vertical axis.

4. The assembly according to claim 1, wherein said assembly comprises a locking device that can lock the trolley into the housing of the dispensing station of the tintometric machine.

5. The assembly according to claim 4, wherein a control system can activate said actuating device for moving said supporting top for positioning said supporting top correctly at the dispenser system for executing a dispensing operation, and then making an opposite movement at an end of the dispensing operation.

6. The assembly according to claim 4, wherein a control system is electrically connected to said plug/socket system and said locking device for monitoring presence of the trolley in the housing of the dispensing station and activating the locking device to lock or release the trolley.

7. The assembly according to claim 1, wherein the tintometric machine comprises an electronic control system, which can control said actuating device of the trolley when the trolley is in the housing and the plug/socket system is in the assembled configuration.

8. The assembly according to claim 1, wherein said external frame has a shell-shaped structure being openable to divide the tintometric machine into at least two portions when the trolley is associated therewith.

* * * * *